US009877579B2

(12) United States Patent
Mansley

(10) Patent No.: US 9,877,579 B2
(45) Date of Patent: Jan. 30, 2018

(54) CABINET AND AN ASSOCIATED METHOD

(71) Applicant: Containit Pty Ltd, Parkes (AU)

(72) Inventor: Stephen Philip Mansley, Parkes (AU)

(73) Assignee: Containit Pty Ltd, Parkes (AU)

( * ) Notice: Subject to any disclaimer, the term of this patent is extended or adjusted under 35 U.S.C. 154(b) by 0 days.

(21) Appl. No.: 15/272,043

(22) Filed: Sep. 21, 2016

(65) Prior Publication Data

US 2017/0079425 A1 Mar. 23, 2017

(30) Foreign Application Priority Data

Sep. 22, 2015 (AU) ..... 2015903867

(51) Int. Cl.

| | |
|---|---|
| ***A47B 67/04*** | (2006.01) |
| ***E05B 65/46*** | (2017.01) |
| ***A47B 88/50*** | (2017.01) |
| *A47B 95/02* | (2006.01) |
| *A47B 88/80* | (2017.01) |
| *A47B 88/969* | (2017.01) |
| *E05B 65/463* | (2017.01) |

(52) U.S. Cl.

CPC ..... *A47B 67/04* (2013.01); *A47B 88/50* (2017.01); *E05B 65/46* (2013.01); *A47B 88/80* (2017.01); *A47B 88/969* (2017.01); *A47B 2095/024* (2013.01); *A47B 2210/08* (2013.01); *E05B 65/463* (2013.01)

(58) Field of Classification Search

CPC ..... A47B 67/04; A47B 51/00; A47B 57/00; A47B 53/06; A47B 63/067; A47B 77/18; A47B 81/00; A47B 88/407; A47B 2210/03

See application file for complete search history.

(56) References Cited

U.S. PATENT DOCUMENTS

| | | | | |
|---|---|---|---|---|
| 3,874,755 A | | 4/1975 | Hegg et al. | |
| 4,535,897 A | * | 8/1985 | Remington | B25H 3/00 211/70.6 |
| 8,746,470 B2 | * | 6/2014 | Reinbigler | A47B 57/04 211/126.15 |
| 2007/0035218 A1 | * | 2/2007 | Chen | E05B 65/463 312/221 |
| 2007/0278918 A1 | * | 12/2007 | Grainger | A47B 67/04 312/330.1 |

(Continued)

OTHER PUBLICATIONS

Bartels Pole Mounted Pull Out Unit, dated Aug. 27, 2015.

(Continued)

*Primary Examiner* — Daniel J Rohrhoff

(74) *Attorney, Agent, or Firm* — Venable LLP; Henry J. Daley

(57) ABSTRACT

The cabinet 1 has a base 3 that defines an opening 7, which is sized to receive the tynes of a lifting device, such as a fork lift of the like, for example. This facilitates transportation of the entire cabinet 1. The cabinet 1 has nine drawers 8, each having formations, in the form of a pair of slots 10 and 11, which are adapted for engagement with the tynes. Once the tynes have been inserted, the lifting device operator may then raise the tynes slightly, thereby supporting the drawer 8 on the tynes. The lifting device operator can then remove the drawer 8 that is being supported by the tynes from the cabinet 1.

17 Claims, 7 Drawing Sheets

(56) References Cited

U.S. PATENT DOCUMENTS

| | | | | |
|---|---|---|---|---|
| 2008/0054768 | A1* | 3/2008 | Lin | E05B 65/463 312/221 |
| 2009/0230828 | A1* | 9/2009 | Thomasson, II | A47B 67/04 312/237 |
| 2009/0273259 | A1* | 11/2009 | Whitney | A47B 67/04 312/119 |
| 2013/0126452 | A1* | 5/2013 | Lo | A47B 67/04 211/79 |
| 2014/0354121 | A1* | 12/2014 | Frison | E05B 65/463 312/221 |

OTHER PUBLICATIONS

BOH FPU Systems.
BOH Portable Drawer Module.
BOH Product Catalog.
Cave Systems Product Presentation.
Ronis Ultra Track.
Sliding Systems Front Locking Handle.

* cited by examiner

CABINET AND AN ASSOCIATED METHOD

TECHNICAL FIELD

The present invention relates to a cabinet and an associated method. Embodiments of the present invention find application, though not exclusively, in logistical contexts that require a plurality of objects to be made available for use, often in remote locations and/or at short notice.

BACKGROUND ART

Any discussion of documents, acts, materials, devices, articles or the like which has been included in this specification is solely for the purpose of providing a context for the present invention. It is not to be taken as an admission that any or all of these matters form part of the prior art base or were common general knowledge in the field relevant to the present invention as it existed in Australia or elsewhere before the priority date of this application.

It is known to provide cabinets having a plurality of drawers with a pallet-type base, which enables the entire cabinet to be lifted by the tynes of a lifting device, such as a fork lift, for example. In such cabinets, the individual drawers may be installed and/or removed from the cabinet by hand. However, it has been appreciated by the present inventors that such prior art cabinets are unsuited to some applications in which an individual drawer may be too heavy or cumbersome to be manipulated by hand.

SUMMARY OF THE INVENTION

It is an object of the present invention to overcome, or substantially ameliorate, one or more of the disadvantages of the prior art, or to provide a useful alternative.

In a first aspect of the present invention there is provided a cabinet having at least one drawer configured to engage with tynes of a lifting device, whereby the drawer is supported within the cabinet such that the drawer is manipulable by the tynes so as to remove the drawer from the cabinet.

Preferably the drawer is also manipulable by the tynes so as to install the drawer into the cabinet.

One embodiment includes a runner configured to support said drawer during displacement of the drawer between a closed position and an open position. In this embodiment the runner is substantially U-shaped and the runner is oriented within the cabinet such that an opening of the U-shape faces towards a front of the cabinet.

Preferably the drawer defines a base having formations adapted for engagement with said tynes. In one embodiment the formations are a pair of slots being spaced apart by a distance corresponding to a spacing of said tynes.

An embodiment of the cabinet includes a locking mechanism configured to lock the drawer in an either an open or a closed position.

In one embodiment the cabinet has a plurality of drawers and includes a mechanism configured to allow only one of the drawers to be in an open position at any one time.

Preferably a locating formation is disposed on the runner so as to mate with a corresponding formation disposed on the drawer when the drawer is seated upon the runner. More preferably the locating formation is a projection and the corresponding formation is a recess shaped to receive the projection.

In one embodiment the runner is shaped so as to guide the drawer towards a seating position upon the runner. In this embodiment the runner includes an inclined member sloping towards the seating position.

Preferably strengthening formations, in the form of ribs, are disposed on the base so as to assist the base to support contents of the drawer whilst the drawer is being supported by the tynes.

Preferably the drawer includes at least one handle disposed on either side of the drawer.

Preferably a height of a region underneath the drawer 8 in which the tynes engage with the drawer is less than 40 mm.

In another aspect of the present invention there is provided method of making a plurality of objects available for use, the method including the steps of:

- providing a cabinet having at least one drawer configured to engage with tynes of a lifting device, whereby the drawer is supported within the cabinet such that the drawer is manipulable by the tynes so as to remove the drawer from the cabinet;
- stowing the plurality of objects within the at least one drawer;
- transporting the cabinet to a location at which the plurality of objects are to be available for use; and
- using the tynes of a lifting device to remove at least one of the drawers from the cabinet, thereby rendering the plurality of objects available for use.

The features and advantages of the present invention will become further apparent from the following detailed description of preferred embodiments, provided by way of example only, together with the accompanying drawings.

BRIEF DESCRIPTION OF THE ACCOMPANYING DRAWINGS

DETAILED DESCRIPTION OF PREFERRED EMBODIMENTS OF THE INVENTION

Figure 1:
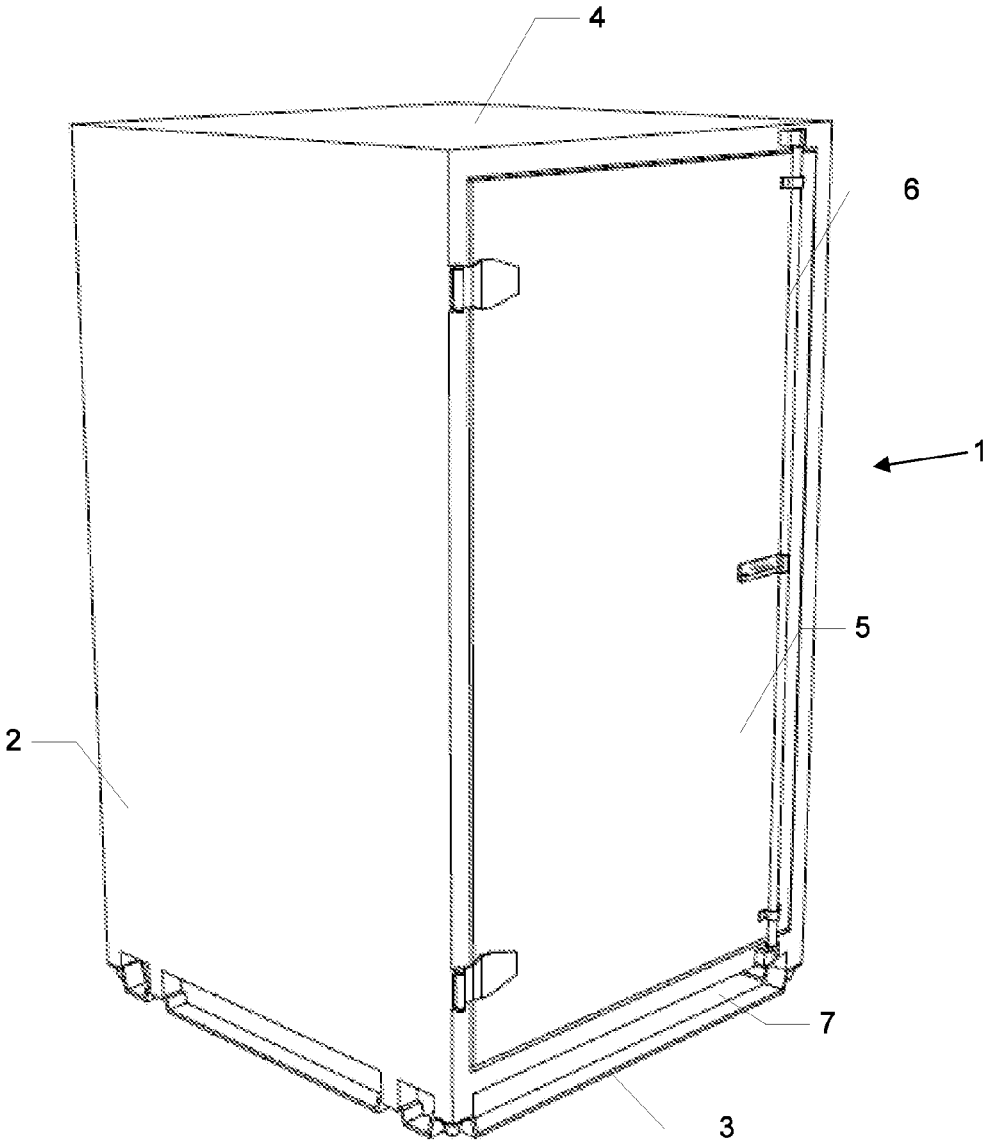
FIG. 1 is a perspective view of a cabinet according to an embodiment of the invention, with the front door in a closed position.

As shown for example in FIG. 1, the external surface of the cabinet 1 is defined by a pair of side walls 2, a base 3, a top panel 4, a rear panel and a door 5. The door 5 is hingedly connected to the left side wall 2 and has a locking mechanism 6 that extends adjacent the right hand side of the door 5 from the base 3 to the top panel 4. The base 3 defines an opening 7, which is sized to receive the tynes of a lifting device, such as a fork lift of the like, for example. This facilitates transportation of the entire cabinet 1.

Figure 2:
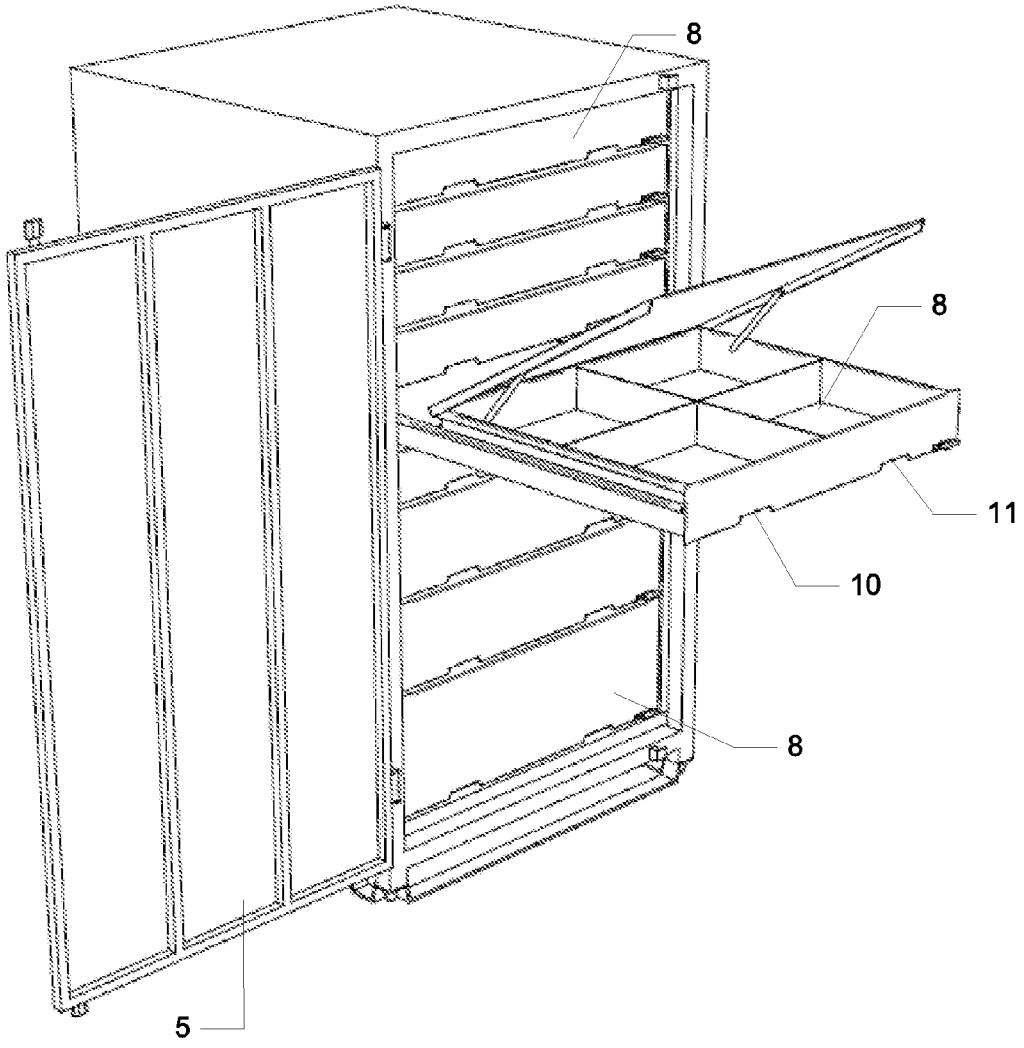
FIG. 2 is a perspective view of the cabinet, with the front door in an open position.

As shown for example in FIG. 2, the cabinet 1 has nine drawers 8 having various depths, each of which is configured to engage with tynes of the lifting device. Each of the drawers 8 defines a base 9 and a front face 25. Formations, in the form of a pair of slots 10 and 11 adapted for engagement with the tynes, are disposed at the base of the front face 25. The spacing between the pair of slots 10 and 11 corresponds to the spacing of the tynes. Hence, it is possible to insert the pair of tynes respectively into the slots 10 and 11. This is preferably done whilst the drawer 8 is in the locked out position. For some embodiments it is possible to insert the pair of tynes whilst the drawer 8 is in the closed position (i.e. whilst the drawer 8 is housed within the cabinet 1), however this is likely to require a greater gap to be provided between adjacent drawers 8.

Once the tynes have been inserted, the lifting device operator may then raise the tynes slightly, thereby supporting the drawer 8 on the tynes. Once thus supported, the lifting device operator can cause the tynes to withdraw from the cabinet 1, for example by reversing away from the cabinet 1, and thereby remove the drawer 8 that is being supported by the tynes from the cabinet 1.

As shown for example in FIGS. 3 to 6 and 13 to 15, a runner 12 is configured to support the drawer 8 within the cabinet 1. Importantly, however, the drawer 8 is not affixed to the runner 12; rather, the drawer 8 is merely supported by the runner 12. More specifically, the drawer 8 is supported on a U-shaped platform defined by horizontal members 13, 14 and 15. As is well known to those skilled in the art, a pair of rails 16 and 17 are disposed on opposite sides of the runner 12. In use the rails 16 and 17 bear upon rollers that are attached to the side walls 2 of the cabinet 1. This allows the U-shaped platform of the runner 12 to support the drawer 8 during displacement of the drawer 8 between the closed position and the open position and whilst the drawer 8 is stationary in the closed or open position. As shown in FIG. 2, the top four drawers, and the lower four drawers, are in the closed position; however the middle drawer 8 is in the open position.

The runner 12 is oriented within the cabinet 1 such that an opening 18 of the U-shape faces towards a front of the cabinet 1. This allows the tynes to pass through the opening 18 when lifting the drawer 8 without fouling against anything (assuming, of course, that the tynes are properly aligned with slots 10 and 11 and do not extend far enough under the drawer 8 so as to impact against horizontal member 14 of the runner 12). An advantage associated with having the opening 18 of the runner 12 facing towards the front of the cabinet 1 is that this allows the height of the region underneath the drawer 8 in which the tynes engage with the drawer 8 to be reduced. In the preferred embodiment, the height of this region is less than 40 mm (i.e. the slots 10 and 11 have a depth of approximately 30 to 35 mm). This compares favourably with an arrangement having a pallet-type formation underneath each drawer because pallet-type formations typically have a height of approximately 70 mm. Hence, the use of an open-fronted runner 12 allows for a the smaller height of the region underneath the drawer 8 in which the tynes engage with the drawer 8, which allows the cabinet 1 of the present invention to accommodate multiple drawers in a space efficient manner.

It is anticipated that in at least some contexts the cabinet 1 may be transported to remote locations and possibly placed upon potentially uneven ground. For this reason it is desirable to protect against the risk of the cabinet 1 inadvertently toppling over due to the off-set weight of the drawers 8 and their contents when in the open position. To help guard against this risk, the preferred embodiment makes use of a known mechanism 19 that is configured to allow only one of the drawers 8 to be in an open position at any one time. This mechanism 19 is disposed at a midpoint of horizontal member 14. One example of such a mechanism is the Ultra-track system as sold by Ronis, which is based in Sancoins, France. Another example of such a mechanism is disclosed in U.S. Pat. No. 3,874,755 entitled Anti-tilt Lock Mechanism, the contents of which are hereby incorporated in their entirety by way of reference.

Figure 13:
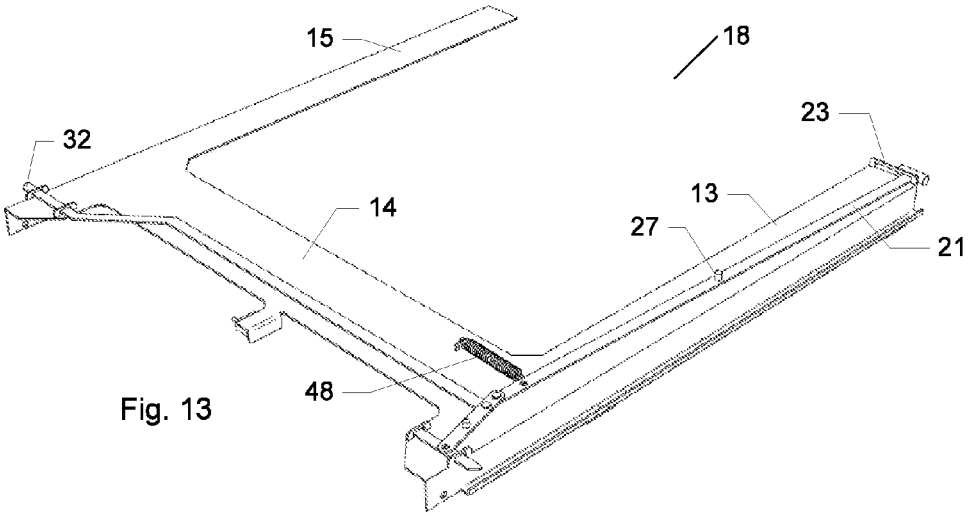
FIG. 13 is a bottom perspective view of the runner.
Figure 14:
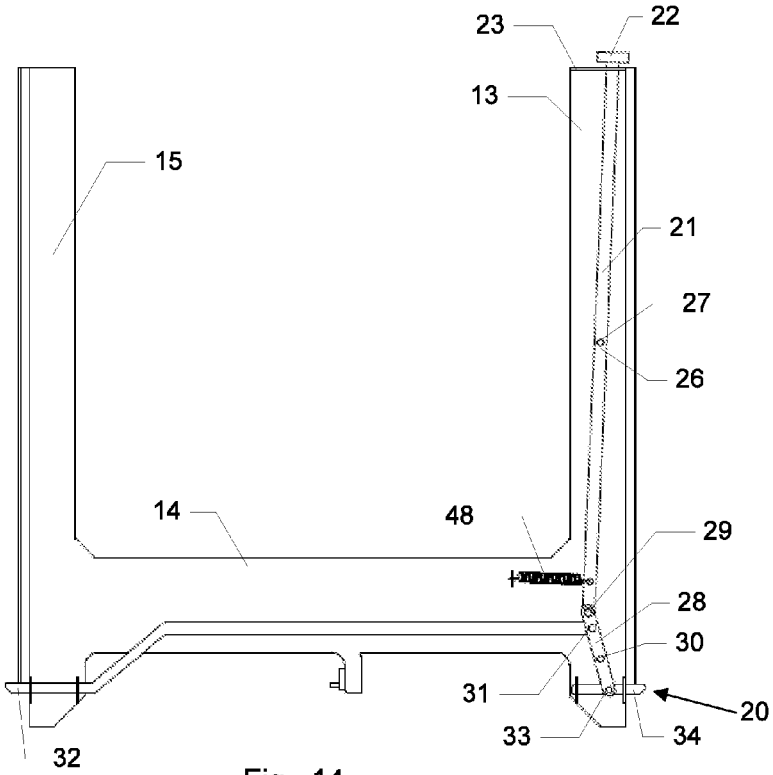
FIG. 14 is a bottom view of the runner.
Figure 15:
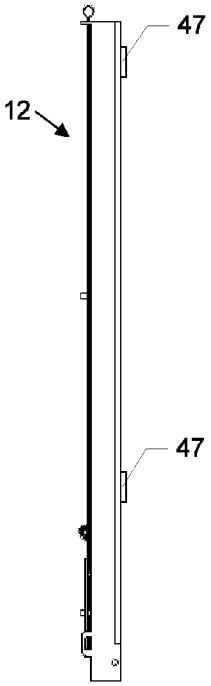
FIG. 15 is a right side view of the runner.

Another risk associated with the potential for the cabinet 1 to be placed on uneven ground is that a person using the cabinet 1 may pull a drawer 8 into the open position and then let it go. If the cabinet 1 is not level, the force of gravity may then cause the drawer 8 to inadvertently close. This has the potential to inflict injury, for example by the jamming of fingers as the drawer 8 unexpectedly slams shut. For this reason each of the runners 12 of the preferred embodiment is equipped with a lock-in/lock-out mechanism 20 configured to lock the drawer 8 in each of the open and the closed positions. In the illustrated embodiments the lock-in/lock-out mechanism 20 takes the form of an elongate member 21 having a proximal end upon which is disposed a handle 22. As best shown in FIGS. 13 and 14, the elongate member 21 is mounted below the horizontal member 13. More particularly, the proximal end of elongate member 21 extends through slot 23 on runner 12. This positions the handle 22 within the aperture 24 that is provided within the front face 25 of the drawer 8. A slot 26 is disposed at approximately a mid-point of elongate member 21 and pin 27 is received within the slot 26. Hence, a user of the cabinet 1 can toggle the handle 22 from side to side causing the elongate member 21 to pivot about pin 27, which results in the distal end of the elongate member 21 moving to the opposite side as compared to that of the handle 22. This movement is communicated to member 28 via pinned connection 29. Member 28 is also pivotally connected via pin 30 to horizontal member 13. A proximal end of member 28 is pivotally connected via pin 31 to first latch 32. A distal end of member 28 is pivotally connected via pin 33 to second latch 34. As best shown in FIGS. 13 and 14, a resilient biasing means, in the form of spring 48, is used so as to bias the mechanism 20 toward the locked state. When in the locked state the handle 22 is positioned to the right hand side, as shown in FIGS. 13 and 14, and the first and second latches 32 and 34 are displaced so as to project from either side of the runner 12 respectively. In this position they respectively engage with one of two pairs of corresponding apertures provided in the side walls 2 of the cabinet 1. The first pair of apertures are positioned towards the rear of the side walls 2. When the first and second latches 32 and 34 extend through the first apertures the drawer 8 is locked in the closed position. The second pair of apertures are positioned towards the front of the side walls 2. When the first and second latches 32 and 34 extend through the second apertures the drawer 8 is locked in the open position.

If the user holds the handle 22 to the left hand side, the first and second latches 32 and 34 are withdrawn so as not to project from either side of the runner 12. This is the unlocked state in which the drawer 8 is free to move (subject to the influence of mechanism 19 mentioned above).

As best shown in FIGS. 13 and 14 the elongate member 21, member 28 and the second latch 34 of the lock-in/lock-out mechanism 20 are positioned underneath horizontal member 13. Additionally, the first latch 32 is positioned underneath, and to the rear, of horizontal member 14. This ensures that the elements of the lock-in/lock-out mechanism 20 do not obstruct the opening 18 through which the tynes of the lifting device must move in order to engage with the slots 10 and 11 in the bottom of the drawer 8.

An alternative embodiment (not illustrated) uses the LILO version of the Heavy Duty Front Locking Handle that is sold by Sliding Systems, which is based in Wrexham, United Kingdom, to provide the lock-in/lock-out mechanism.

Figure 10:
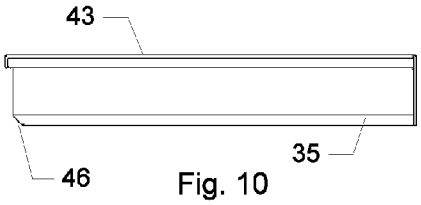
FIG. 10 is a side view of the drawer.
Figure 11:
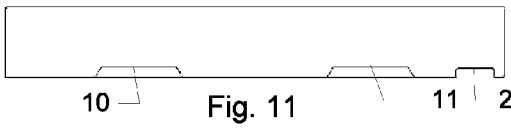
FIG. 11 is a front view of the drawer.
Figure 12:
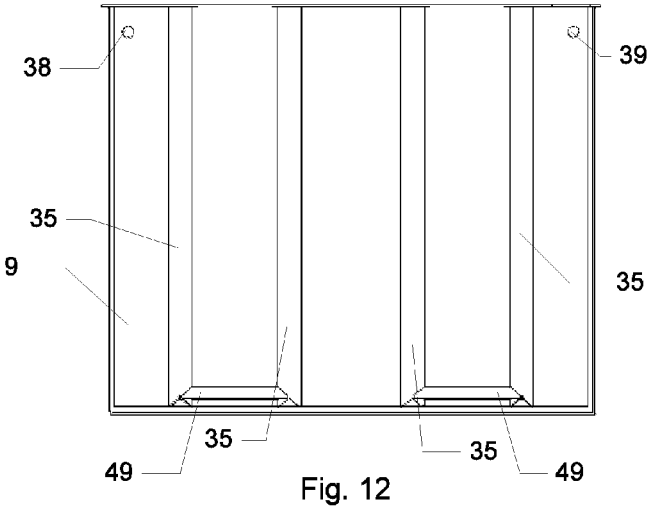
FIG. 12 is a bottom view of the drawer.

As best shown for example in FIG. 12, strengthening formations in the form of ribs 35 are disposed on the base 9 of the drawer 8. This assists the base 9 to support the contents of the drawer 8 whilst the drawer is being supported by the tynes. The ribs 35 are divided into two pairs, with each pair being disposed on either side of each slot 10 and 11. The ribs extend along the base 9 from the front of the drawer 8 to the rear of the drawer 8. As best shown in FIG. 10, the rear end of the ribs 35 have a taper 46, which provides clearance to ensure that the rear ends of the ribs 35 do not foul against inclined member 40 when the drawer 8 is seated upon the runner 12. These ribs also function to assist in guiding the tynes during engagement with the slots 10 and 11. The rear ends of the ribs each include stops 49, which the distal ends of the tynes impact upon if the tynes are accidentally inserted too far to the rear of the base 9. This provides an indication to the operator of the lifting device not to insert the tynes any further.

Figure 3:
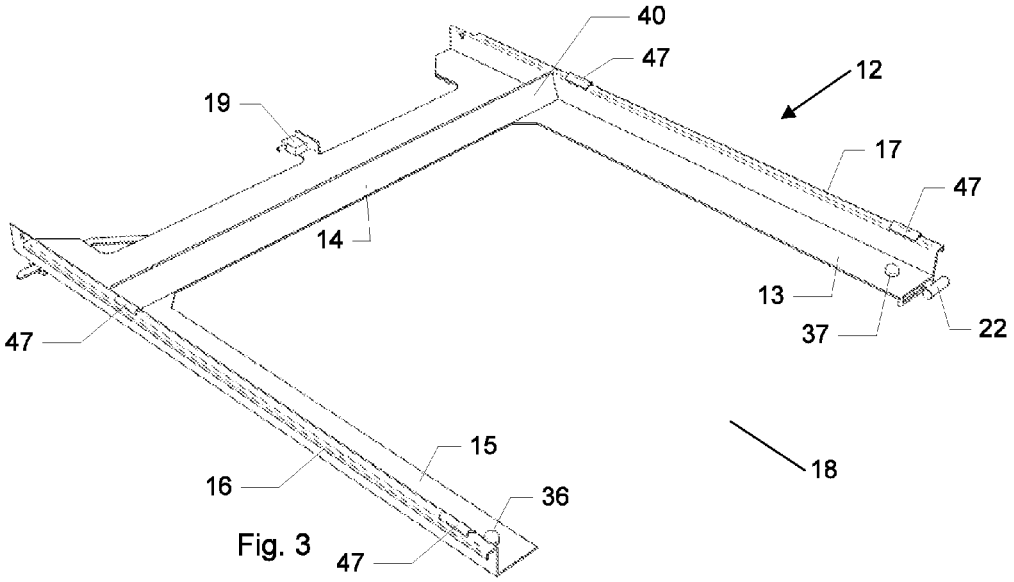
FIG. 3 is a perspective view of a runner used in the cabinet.
Figure 5:
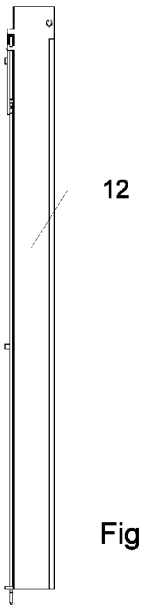
FIG. 5 is a left side view of the runner.
Figure 4:
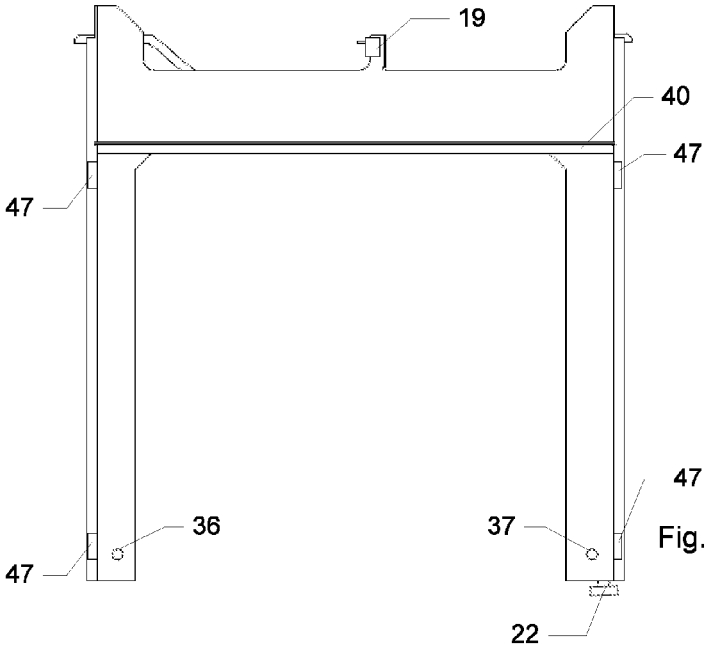
FIG. 4 is a plan view of the runner.
Figure 6:
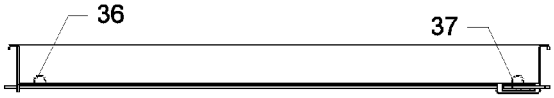
FIG. 6 is a front view of the runner.
Figure 7:
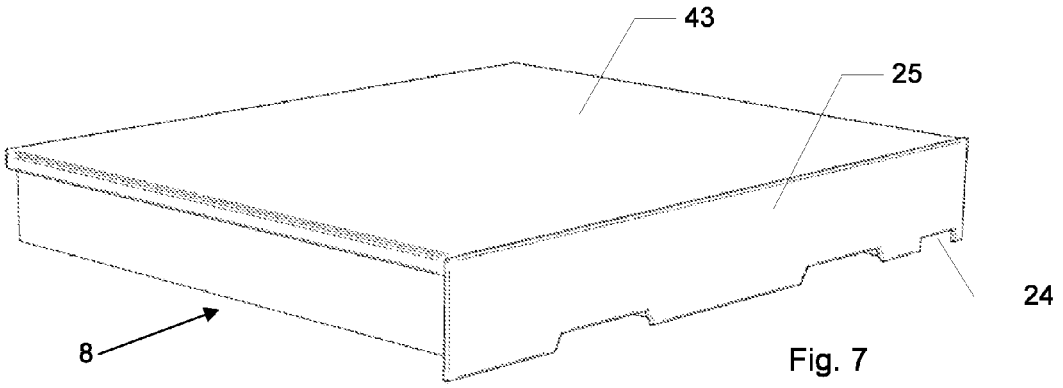
FIG. 7 is a perspective view of a drawer used in the cabinet, with a lid in a closed position.

It is possible not only to remove a drawer 8 from the cabinet 1 using the tynes of a lifting device, but also to install the drawer 8 into the cabinet 1 using the tynes. The process for installing the drawer 8 is essentially the reverse of the above-described process for removing the drawer 8. However, various formations are provided upon the runner 12 to ease the seating of the drawer 8 onto the runner 12 in the desired position. As best seen in FIGS. 3, 4 and 6, a pair of locating formations in the form of cylindrical projections 36 and 37 are disposed towards the front of the horizontal members 13 and 15 of the runner 12. These cylindrical projections 36 and 37 each have a rounded head to assist mating with corresponding formations in the form of recesses 38 and 39 disposed on the base 9 of the drawer 8. The relationship between the positioning of the cylindrical projections 36 and 37 and the positioning of the recesses 38 and 39 is such that the drawer 8 is properly seated upon the runner 12 when the cylindrical projections 36 and 37 mate with the recesses 38 and 39. As best shown for example in FIGS. 3 and 4, a pair of tabs 47 is disposed on each of the rails 16 and 17 of the runner 12. These tabs 47 function as additional formations that ease the seating of the drawer 8 onto the runner 12. The upper surfaces of the tabs 47 are shaped so as to guide the drawer 8 toward the correct seating position as the drawer 8 is being lowered toward the runner 12. To ease the process, the drawer 8 is preferably installed onto the runner 12 whilst the runner 12 is in the locked out position.

Although not shown on the figures, a stop may be defined on the proximal end of horizontal member 15, which functions to inhibit the drawer 8 from being inadvertently pulled off the front end of the runner 12 unless the drawer 8 is lifted a sufficient height off the runner 12 so as to clear the stop.

The installation of a drawer 8 is also assisted by the shaping of the runner 12 so as to guide the drawer 8 towards its seating position. More particularly, (as best shown in FIG. 3) the runner 12 includes an inclined member 40 which slopes towards the seating position of the lower rear edge of the drawer 8 on the runner 12.

Figure 16:
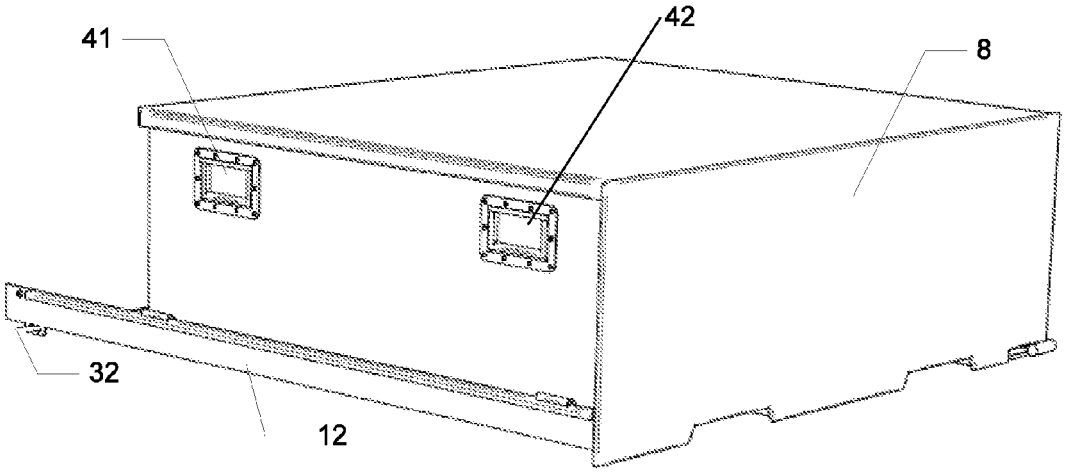
FIG. 16 is a perspective view of an alternative embodiment of a drawer.

The embodiment of the drawer 8 depicted in FIG. 16 has a pair of handles 41 and 42 disposed each side of the drawer 8. These may be used to provide a manual alternative to using the tynes of a lifting mechanism to remove and/or install the drawer 8. Additionally, they may be used to allow steadying of the drawer 8 whilst it is being manipulated by the tynes.

Figure 8:
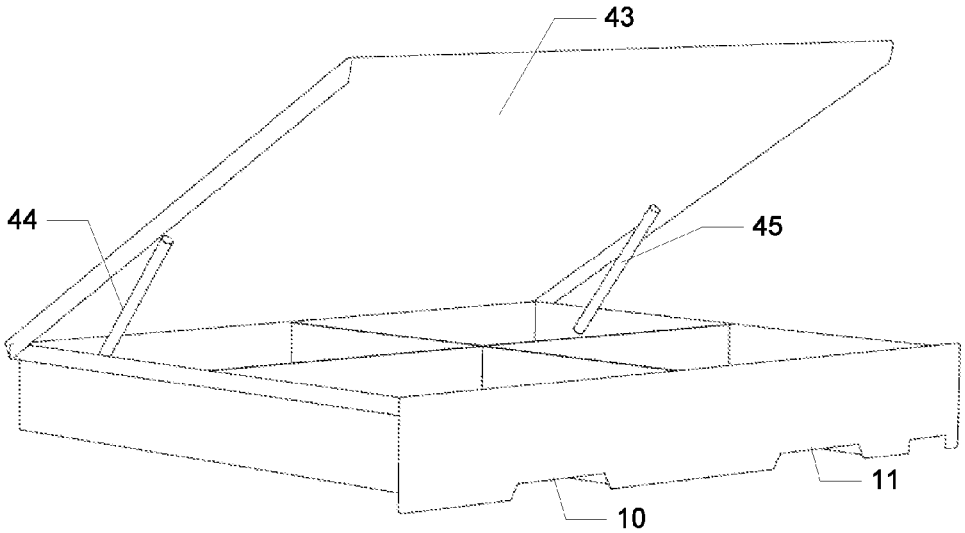
FIG. 8 is a perspective view of the drawer, with the lid in an open position.
Figure 9:
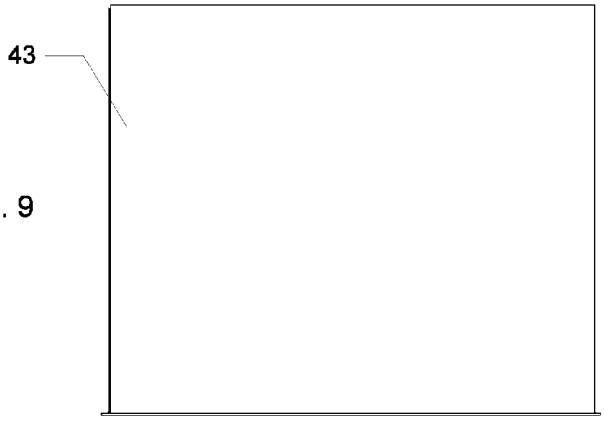
FIG. 9 is a plan view of the drawer.

The drawers 8 depicted in the figures each have a lid 43 that is hingedly connected to the back upper edge of the drawer 8. Gas struts 44 and 45 are used to support the lid 43 in the raised position as illustrated in FIG. 8. Other embodiments (not illustrated) dispense with the lid and instead utilise open topped drawers.

As shown in FIG. 2, the upper six drawers 8 are of a shallower depth and the lower three drawers 8 are of a deeper depth. However, some embodiments of the cabinet 1 include multiple redundant runners 12, which allow the cabinet 1 to be configured so as to house a different combination of shallow and deep drawers 8, or to house solely shallow drawers 8, or solely deep drawers 8, as required. It will be appreciated by those skilled in the art that re-configuring the cabinet 1 to house a different drawer configuration will also necessitate corresponding re-configuring of the system in which the mechanism 19 functions.

It is anticipated that embodiments of the cabinet 1 are likely to be particularly useful in contexts in which large numbers of objects are required to be made available for use, possibly in a remote location and perhaps on short notice. By way of non-limiting example, a remote army deployment may require a large amount of army hardware to be transported to a remote location such as a desert for example. Another example might apply in a mining context in which it may be necessary to transport spare parts to a remote location at which a mining vehicle, or other mining equipment, may have broken down. Yet another example may be a motor racing team wishing to use the cabinet 1 as a mobile warehouse to equip a temporary pit area with the spare parts and other equipment required for a race meeting. A further such example may apply in a rescue context in which a rapid response may require rescue equipment to be speedily gathered and deployed to a remote location.

In contexts such as those mentioned above, it may be logistically advantageous to maintain a storage area in which drawers 8 are pre-packed with various objects. Typically the contents of each drawer 8 may weigh approximately 200 to 300 kilograms. When preparing to leave the storage area to achieve a particular mission, the operator of a lifting device such as a fork lift would be given a list identifying the drawers 8 that are required to be installed into the cabinet 1. These would be the drawers 8 into which the objects necessary for the particular mission had previously been stowed. The lifting device operator would then use the tynes to install each of the identified drawers 8 into the cabinet and finally, once all of the required drawers have been loaded, the lifting device operator would place the loaded cabinet 1 into a transport vehicle. As mentioned above, the spring 48 biases the locking mechanism 20 into the locked state, which helps to ensure that none of the drawers 8 inadvertently open whilst the cabinet 1 is in transit.

Once at the location at which the objects are to be available for use, the lifting device operator would remove the cabinet 1 from the transport vehicle (if necessary). The lifting device operator would then use the tynes of the lifting device to remove the drawers 8 containing the objects required for the mission from the cabinet 1. The drawers 8 would then be placed in positions from which the objects therein could be conveniently made available for use, such as on a bench, on the ground, etc.

Alternatively, it would be possible to allow all of the drawers 8 to remain in the cabinet and to simply open the drawers 8 as required to access the objects stowed within. As the contents of individual drawers 8 empty or run low it would be possible for the operator of the lifting device to use the tynes to remove the spent drawer 8 from the cabinet 1 and replace it with a fully provisioned drawer 8.

In the embodiments disclosed above, the cabinet 1 is enclosed by sheet metal panels that form the side walls 2, base 3, top 4 and the door 5. However, it will be appreciated that the term "cabinet" as used in this document, including within the claims, is to be construed so as to include unenclosed cabinets. Additionally, the term "cabinet" as used in this document, including within the claims, is to be construed so as to include from the reconfiguring of a container that may have been originally built for another purpose, such as a shipping container for example, so as to function as a cabinet.

While a number of preferred embodiments have been described, it will be appreciated by persons skilled in the art that numerous variations and/or modifications may be made to the invention without departing from the spirit or scope of the invention as broadly described. The present embodiments are, therefore, to be considered in all respects as illustrative and not restrictive.

The claims defining the invention are as follows:

1. A cabinet having at least one drawer configured to engage with tynes of a lifting device, whereby the drawer is supported within the cabinet such that the drawer is manipulable by the tynes so as to remove the drawer from the cabinet, wherein the drawer defines a base having formations adapted for engagement with said tynes, and wherein the formations are a pair of slots being spaced apart by a distance corresponding to a spacing of said tynes.

2. A cabinet according to claim 1 wherein the drawer is manipulable by the tynes so as to install the drawer into the cabinet.

3. A cabinet according to claim 1 including a runner configured to support said drawer during displacement of the drawer between a closed position and an open position.

4. A cabinet according to claim 3 wherein the runner defines an opening and wherein the runner is oriented within the cabinet such that an opening faces towards a front of the cabinet.

5. A cabinet according to claim 4 wherein the runner is substantially U-shaped.

6. A cabinet according to claim 3 further including a locating formation being disposed on the runner so as to mate with a corresponding formation disposed on the drawer when the drawer is seated upon the runner.

7. A cabinet according to claim 6 where the locating formation is a projection and wherein the corresponding formation is a recess shaped to receive the projection.

8. A cabinet according to claim 3 wherein the runner is shaped so as to guide the drawer towards a seating position upon the runner.

9. A cabinet according to claim 8 wherein the runner includes an inclined member sloping towards the seating position.

10. A cabinet according to claim 1 including a locking mechanism configured to lock the drawer in an either an open or a closed position.

11. A cabinet according to claim 1 wherein the cabinet has a plurality of drawers and including a mechanism configured to allow only one of the drawers to be in an open position at any one time.

12. A cabinet according to claim 1 wherein strengthening formations are disposed on the base so as to assist the base to support contents of the drawer whilst the drawer is being supported by the tynes.

13. A cabinet according to claim 12 wherein the strengthening formations are ribs.

14. A cabinet according to claim 1 wherein the drawer includes at least one handle disposed on either side of the drawer.

15. A cabinet according to claim 1 wherein a height of a region underneath the drawer in which the tynes engage with the drawer is less than 40 mm.

16. A method of making a plurality of objects available for use, the method including the steps of:

providing a cabinet having at least one drawer configured to engage with tynes of a lifting device, whereby the drawer is supported within the cabinet such that the drawer is manipulable by the tynes so as to remove the drawer from the cabinet, wherein the drawer defines a base having formations adapted for engagement with said tynes and wherein the formations are a pair of slots being spaced apart by a distance corresponding to a spacing of said tynes;

stowing the plurality of objects within the at least one drawer;

transporting the cabinet to a location at which the plurality of objects are to be available for use; and using the tynes of a lifting device to remove at least one of the drawers from the cabinet, thereby rendering the plurality of objects available for use.

17. A cabinet having at least one drawer configured to engage with tynes of a lifting device, whereby the drawer is supported within the cabinet such that the drawer is manipulable by the tynes so as to remove the drawer from the cabinet, the cabinet including a runner configured to support said drawer during displacement of the drawer between a closed position and an open position, wherein the runner is shaped so as to guide the drawer towards a seating position upon the runner, and wherein the runner includes an inclined member sloping towards the seating position.

* * * * *